United States Patent [19]

Shend'ge

[11] Patent Number: 4,938,397

[45] Date of Patent: Jul. 3, 1990

[54] HAT ADJUSTING TECHNIQUE

[76] Inventor: Vasant J. Shend'ge, 115 Erskine Hill, London NW11 6HU, England

[21] Appl. No.: 214,690

[22] Filed: Jul. 1, 1988

Related U.S. Application Data

[63] Continuation-in-part of Ser. No. 940,034, Dec. 10, 1986, abandoned.

[30] Foreign Application Priority Data

Dec. 10, 1985 [GB] United Kingdom ..... 8530371

[51] Int. Cl.[5] ..... A42C 1/00; A42C 3/00; A42B 1/22

[52] U.S. Cl. ..... 223/7; 2/192; 2/197; 29/235; 29/241; 29/278; 29/437; 29/451; 493/379; 493/938

[58] Field of Search ..... 2/192, 171.1, 190, 195, 2/196, 197, 200, 321; 29/278, 437, 451; 24/20 TT, 456; 223/7; 128/169, 171; 493/379, 938, 959

[56] References Cited

U.S. PATENT DOCUMENTS

| | | | |
|---|---|---|---|
| 1,357,012 | 10/1920 | Tweto | 29/278 X |
| 1,385,220 | 7/1921 | Marquette | 29/451 X |
| 1,709,578 | 4/1929 | Ingram | 2/192 |
| 1,725,803 | 8/1929 | Ingram | 2/192 |
| 1,955,098 | 4/1934 | Shaffer et al. | 2/200 X |
| 2,902,849 | 9/1959 | Gipsus | 29/278 X |
| 3,460,541 | 8/1969 | Doherty | 128/207.15 |
| 3,564,950 | 2/1971 | Jorczak et al. | 29/278 X |
| 4,055,857 | 11/1977 | Brucciani | 2/197 |
| 4,240,192 | 12/1980 | Davis | 29/278 X |
| 4,309,994 | 1/1982 | Grunwald | 604/284 |

FOREIGN PATENT DOCUMENTS

| | | | |
|---|---|---|---|
| 255747 | 7/1926 | United Kingdom | 2/321 |

*Primary Examiner*—Wm. Carter Reynolds
*Attorney, Agent, or Firm*—Connolly and Hutz

[57] ABSTRACT

A flap is inserted in a similarly shaped and sized tubular opening with the aid of a tool, slots in the flap being engaged by hooks on the tool and being entrained thereby. The tool is inserted into the opening with the flap, and upon withdrawal of the tool, the hooks automatically disengage from the slots so that flap remains within opening. The flap and the tubular opening constitute opposite ends of part of a disposable paper hat.

3 Claims, 2 Drawing Sheets

HAT ADJUSTING TECHNIQUE

This application is in part a continuation of application Ser. No. 940,034 filed Dec. 10, 1986 now abandoned.

BACKGROUND OF THE INVENTION

The present invention relates to an insertion member and a method of use thereof, and more particularly to its use in the insertion of a flap into a tubular opening.

Disposable paper hats are widely worn by staff in the food retail trade. One such hat, which is well-known and described in U.S. Pat. No. 4,055,857, comprises a first paper member in the form of a strip which is arranged to be shaped generally into a circle to fit around the head. A second paper member in the form of a sheet of thinner material is connected to the inner circumference of the first paper member to cover the top of the head. The strip formed by the first paper member is actually of double thickness and comprises a flattened tube.

During assembly of the hat, one necessary step is to insert one end of the flattened tube into the other. At present, although the other manufacturing steps are performed automatically, this step is performed manually.

It is first necessary to open one of the ends of the flattened tube; this is generally done by blowing on it. The other (still flat) end of the tube is then inserted into the opened end; this is a difficult operation since the two ends are of the same size. Also moving the flat end inside the open end meets with a certain frictional resistance. Accordingly this step is time-consuming and involves expensive labor costs.

SUMMARY OF THE INVENTION

The present invention seeks to overcome or reduce the above disadvantages.

Of course, it would be possible for the tube ends to be assembled by permanently attaching them to each other (e.g. by glueing or stapling) but the ends are required to be slidable in use so that the size of the hat (i.e. the circumference of the first paper member) can be adjusted to fit the wearer's head.

According to a first aspect, the invention provides a method of inserting a first member into an open end of a tubular member, the method comprising providing said first member with first engagement means, providing a tool comprising a generally flat head portion having a width less than or equal to the width of said tubular member, said head portion having second engagement means, inter-engaging said first and second engagement means to form a one-way drive connection, inserting said head portion into said open end and moving it along and within said tubular member entraining said first member therewith, and then disengaging and withdrawing said tool.

According to a second aspect, the invention provides the combination of a hat and an associated tool, said hat having a circumferential strip comprising a substantially flattened tubular member having a first end, said first end being open, and a second end, said second end forming a flap, said flap having first engagement means, and said tool being substantially planar and having a head portion, said head portion having a width less than or equal to the width of said substantially flattened tubular member, and said head portion having second engagement means, said second engagement means forming a one-way drive connection with said first engagement means.

According to a third aspect, the invention provides a tool for inserting a flap into the open end of a substantially flattened tubular member, said tool being substantially planar and comprising a head portion having the shape of an arrow-head, said head portion having one or more projecting one-way engagement means.

According to a fourth aspect, the invention provides a hat having a first paper member comprising a circumferential strip in the form of a substantially flattened tubular member, and a second paper member in the form of a sheet connected to the inner circumference of said circumferential strip, one end of said tubular member being provided with one or more through holes.

BRIEF DESCRIPTION OF THE DRAWINGS

A preferred embodiment of the present invention will now be described, by way of example only, with reference to the accompanying drawings, of which.

DESCRIPTION OF THE PREFERRED EMBODIMENT

Basically, the present invention provides a method of inserting a first member into an open end of a tubular member comprising providing the first member with first engagement means, providing a tool comprising a generally flat head portion having a width less than or equal to the width of the tubular member and also having second engagement means, inter-engaging the first and second engagement means to form a one-way drive connection, inserting the head portion into the open end and moving it along and within the tubular member entraining the first member therewith, and then disengaging and withdrawing the tool.

The first engagement means may be constituted by one or more holes in the first member, preferably two slots. The second engagement means may be constituted by one or more projections on the head portion of the tool, preferably two narrow hook members spaced apart by the same distance as the slots.

The tubular member is generally substantially flattened and the first member is a flap preferably of substantially the same width as the flattened tubular member. In a preferred arrangement, the flap constitutes the other end of the flattened tubular member. Preferably the corners at the end of the flap are slightly tapered, and the entering end of the tool also tapered, to simplify the insertion.

The tubular member is preferably arranged to form the circumferential member of a disposable paper hat.

The present invention also provides the combination of a hat and an associated tool, the hat having a circumferential strip comprising a substantially flattened tubular member having one end open and the other end forming a flap, the flap having first engagement means, and the tool being substantially planar and having a head portion of a width less than or equal to the width of the flattened tubular member and also having second engagement means which form a one-way drive connection with the first engagement means.

The present invention also provides a tool for inserting a flap into the open end of a substantially flattened tubular member, the tool being substantially planar and comprising a head portion having the shape of an arrow-head and having one or more projecting one-way engagement means.

The present invention also provides a hat having a circumferential strip in the form of a substantially flattened tubular member, one end of the tubular member being provided with one or more through holes.

Figure 1:
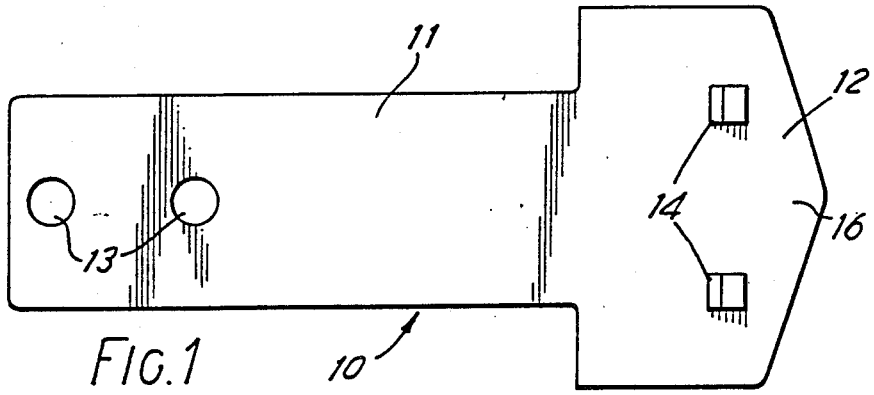
FIG. 1 shows a plan view of an insertion tool for use in a method in accordance with the present invention.
Figure 2:
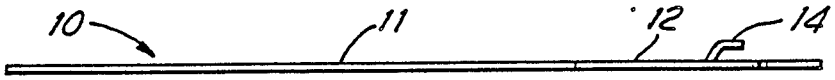
FIG. 2 shows a side view of the tool of FIG. 1.

Referring now to the drawings, FIGS. 1 and 2 show an insertion tool 10. The tool comprises a shank portion 11 and a shaped head portion 12. The nose 16 of head portion 12 is tapered like an arrow-head and has two laterally-spaced hook members 14. The tool is of a material preferably metal, stiffer than paper, and hook members 14 are conveniently stamped out of the head portion.

Figure 3:
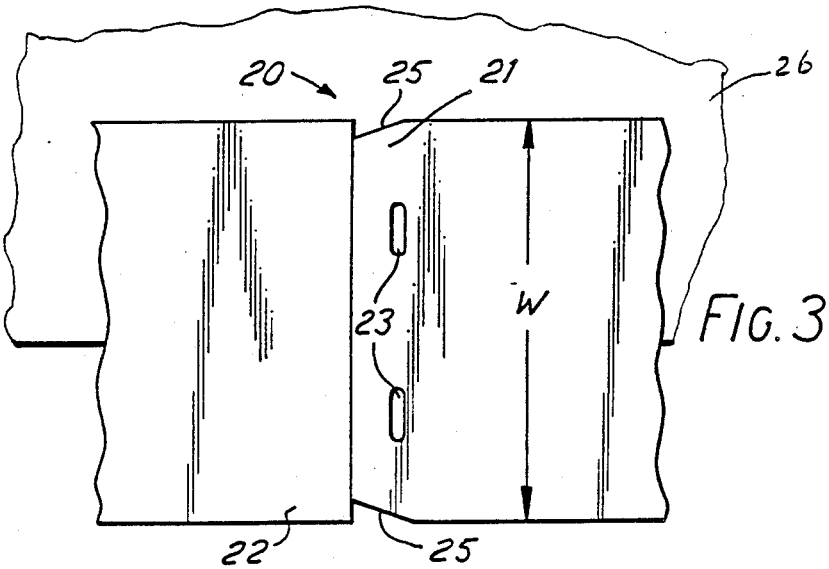
FIG. 3 is a broken-away detail view of a hat having a circumferential tubular strip, one end of which is a flap member about to be inserted into a substantially flattened tubular opening in the other end of the strip, in accordance with the present invention.
Figure 4:
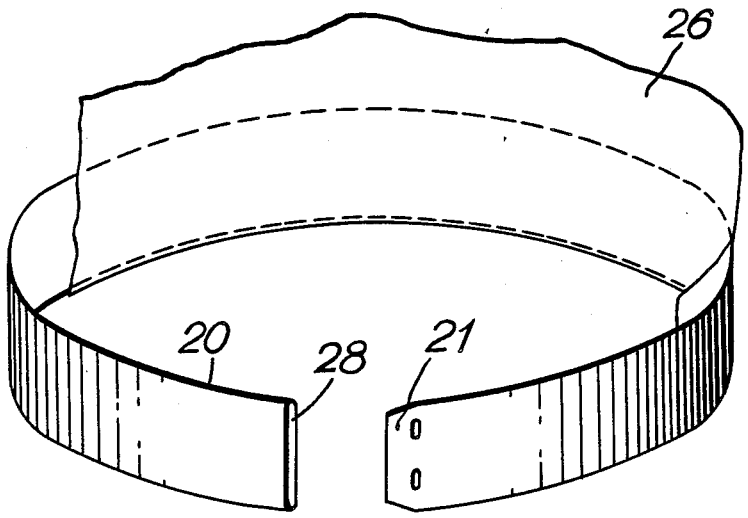
FIG. 4 is a perspective view of the circumferential strip.

FIG. 3 shows part of a paper hat of the disposable type used in the catering and other food-handling trades, or in other fields where hygiene is important. Such uses are well known. This figure shows the ends 21,22 of the circumferential strip 20 intended to go around the head of the wearer. Strip 20 is shown in its entirety in FIG. 4 and is formed from a single thickness of paper for example, having a width approximately equal to or a little larger than twice w, and folded longitudinally as illustrated in U.S. Pat. No. 4,055,857. Thus strip 20 is of generally double thickness with a little internal overlap, and in the form of a flattened tube; the overlap may extend from one end of the tube to the other, and all or part of the overlap may be secured together, e.g. by glueing, if desired.

One end 21 of the strip 20 is maintained flat to form a flap member and is provided with two aligned slots 23, of which the centers are separated by the same distance as the centers of hook members 14. The corners 25 of end 21 are slightly tapered.

The other end 22 of the strip 20 is arranged to be opened out slightly to form a tubular opening 28 and to permit insertion of end 21.

The crown of the hat is shown at 26, and can be tissue paper folded and glued to the inner face of the strip, as in U.S. Pat. No. 4,055,857. The crown can be pleated or folded so that it can be folded flat to fit entirely within strip 20 when the hat is flattened, but can be unfolded to extend above the strip as in FIG. 3, when the hat is worn.

In use hook members 14 are inserted in slots 23. Tool 10 is arranged generally parallel with the ends 21, 22 and head portion 12 is pushed into the open end 22. At the same time hook members 14 push the edges of slots 23 to carry along flap member 21. When slots 23 have been moved the required distance within end 22, the tool is then withdrawn. Hook members 14 disengage automatically from slots 23 and the end 21 remains where it is. Size markings can be applied along a lateral edge of the flap, or on the tool 10, to indicate when the tool penetration has brought the circumferential strip to the desired head size.

The advantage of the above-described arrangement is that it permits both easy insertion of end 21 into end 22, and easy movement of end 21 once within end 22. The arrow-head shape of nose 16 permits quick and guided entry of end 21 into end 22, and the tapering of the corners 25 assists in this. The positive drive of hook members 14 against the edges of slots 23 readily overcomes the frictional resistance between the portions of the paper strip.

The tool 10 may be operated manually; the rate at which hat fitting operations can be performed by an operator is substantially increased with the tool. Alternatively and more advantageously, the tool movement can be automated, e.g. by attaching tool 10 with the help of mounting holes 13 to a reciprocating arm, thus providing an automatic handling device for the paper hats.

Various additional modifications may be made to the above-described arrangement.

For example alternative one-way drive connections may be provided between the tool 10 and the end 21 of the hat. The tool may have slots and the end 21 of the strip, if of sufficiently stiff material, may be provided with suitable engaging projections.

The material of strip 20 may be other than paper, e.g. card or plastics material.

Flap 21 may be of single thickness, or have its walls glued together.

The arrangement may be used elsewhere than in connection with hats. It may be employed wherever it is required to insert a flap member into an opening of similar size.

It will be understood that the above description of the present invention is susceptible to various further modifications, changes and adaptations.

I claim:

1. A method of inserting a first member into an open end of a substantially flattened tubular member, the method comprising providing said first member as a flap on the other end of the substantially flattened tubular member, providing the flap with first engagement means, introducing a substantially planar tool comprising a head portion having a width less than or equal to the width of said tubular member, said head portion having second engagement means, inter-engaging the first and second engagement means to form a one-way drive connection, inserting said head portion into said open end and moving it along in said one way within said tubular member entraining said first member therewith, and withdrawing said tool and disengaging said first and second engagement means, leaving said first member inserted in said open end.

2. A method according to claim 1, wherein said substantially flattened tubular member constitutes an adjustable circumferential member of a hat.

3. The combination of a hat and an associated tool, said hat comprising a circumferential strip comprising a substantially flattened tubular member having a first end, said first end being open, and a second end, said second end forming a flap, said flap having first engagement means, and said tool being substantially planar and having a head portion, said head portion having a width less than or equal to the width of said substantially flattened tubular member, and said head portion having second engagement means, said second engagement means forming a one-way drive connection with said first engagement means.

* * * * *